United States Patent [19]

Milliman et al.

[11] Patent Number: 5,003,691

[45] Date of Patent: Apr. 2, 1991

[54] MECHANICAL TUBE EXPANDER WITH HAIRPIN BEND SUPPORT

[75] Inventors: James G. Milliman; Lawrence A. Franks, both of Sturgis, Mich.

[73] Assignee: Burr Oak Tool & Gauge Company, Sturgis, Mich.

[21] Appl. No.: 549,455

[22] Filed: Jul. 6, 1990

[51] Int. Cl.[5] ..... B23P 15/26

[52] U.S. Cl. ..... 29/727; 29/726; 269/45; 269/266; 269/900

[58] Field of Search ..... 29/726, 726.5, 727, 29/723; 269/37, 45, 266, 900

[56] References Cited

U.S. PATENT DOCUMENTS

| | | | |
|---|---|---|---|
| 4,088,312 | 5/1978 | Frosch et al. | 269/266 |
| 4,291,218 | 9/1981 | Myhre | 269/37 |
| 4,641,819 | 2/1987 | Polard | 269/45 |
| 4,780,955 | 11/1988 | Stroup | 29/727 |
| 4,834,358 | 5/1989 | Okolischon et aL. | 269/900 |
| 4,835,828 | 6/1989 | York et al. | 29/727 |
| 4,839,950 | 6/1989 | Stroup | 29/727 |
| 4,858,296 | 8/1989 | Cray | 29/727 |

*Primary Examiner*—P. W. Echols
*Assistant Examiner*—Irene Cuda
*Attorney, Agent, or Firm*—Flynn, Thiel, Boutell & Tanis

[57] ABSTRACT

A hairpin tube receiver includes a plurality of inependently rotatable receiver posts which have cavities in their upper ends for receiving the bends of hairpin tubes. The receiver posts can be independently rotated to selectable positions in order that the hairpin tube receiver can support the bends of hairpin tubes which are arranged in a variety of different configurations.

18 Claims, 3 Drawing Sheets

MECHANICAL TUBE EXPANDER WITH HAIRPIN BEND SUPPORT

This invention relates to an improved receiver for receiving and supporting the bends of hairpin tubes (U tubes). More particularly, the invention provides an improved receiver for use in a mechanical tube expander to support the bends (180° bends) at corresponding ends of the hairpin tubes of a tube and fin-type heat exchanger while the tubes are being expanded to fix the fins thereon.

DESCRIPTION OF THE PRIOR ART

Tube and fin-type heat exchangers employing hairpin tubes (U tubes) are assembled in a mechanical tube expander by expanding the tubes into interference fits with the fins and end sheets of the heat exchanger. The hairpin tubes (U tubes) are comprised of two straight legs and a bend which is bent through an arc of 180°.

Referring to FIG. 7, there is schematically illustrated, for background purposes, a simplified assembly comprised of a single hairpin tube T and fragments of a plurality of fins F. It will be understood, however, that in the actual manufacture of a tube and fin-type heat exchanger, there will be employed a plurality of tubes T arranged in a fixed pattern. Before the tube T is expanded, the fins F fit loosely on the tube T. In use of the mechanical tube expander, the expander rods 16, which carry expander bullets 15, are moved through the tube T so that the tube is expanded into a tight, interlocked relationship (interference fit) with the fins F to provide an integral, permanent assembly thereof and to provide good heat transfer therebetween.

The tube T has a hairpin bend 13 at its lower end. The hairpin bend 13 is supported in a correspondingly shaped cavity 18 in a receiver 14.

Referring to FIG. 1, in the receivers 14 used in the prior art, a plurality of cavities 18 are provided either in a single block or in a plurality of blocks which are positioned and secured together in side-by-side relationship. The block or blocks of the receiver 14 are removably mounted on a receiver support plate 20 (FIG. 1). If a change is made in the pattern of the hairpin bends of the tubes in the heat exchanger, it is necessary to remove the receiver 14 from the receiver support plate 20 and either replace or rearrange the blocks of the receiver as necessary to accommodate the desired new pattern of the hairpin bends. This is difficult and time consuming. Moreover, it may be necessary to maintain an inventory of a substantial number of differently configured blocks so that a wide variety of patterns of hairpin bends can be provided.

SUMMARY OF THE INVENTION

In accordance with this invention, there is provided a hairpin bend receiver comprising base means, a plurality of separate, upright, elongated, parallel, receiver posts extending upwardly from the base means and located in side-by-side relationship to each other. Each of the receiver posts has a cavity in its upper end, which cavity is adapted for receiving approximately one-half of the circumference of the hairpin bend of a tube. The receiver posts are supported for individual, independent rotation with respect to each other. Detent means are provided for selectably and releasably retaining each of the receiver posts in one of a plurality of circumferentially spaced-apart positions. The cavities in the upper ends of the receiver posts can thereby be arranged in a wide variety of patterns so that variations of the pattern of the hairpin bends of the tubes can be accommodated.

DETAILED DESCRIPTION

Figure 1:
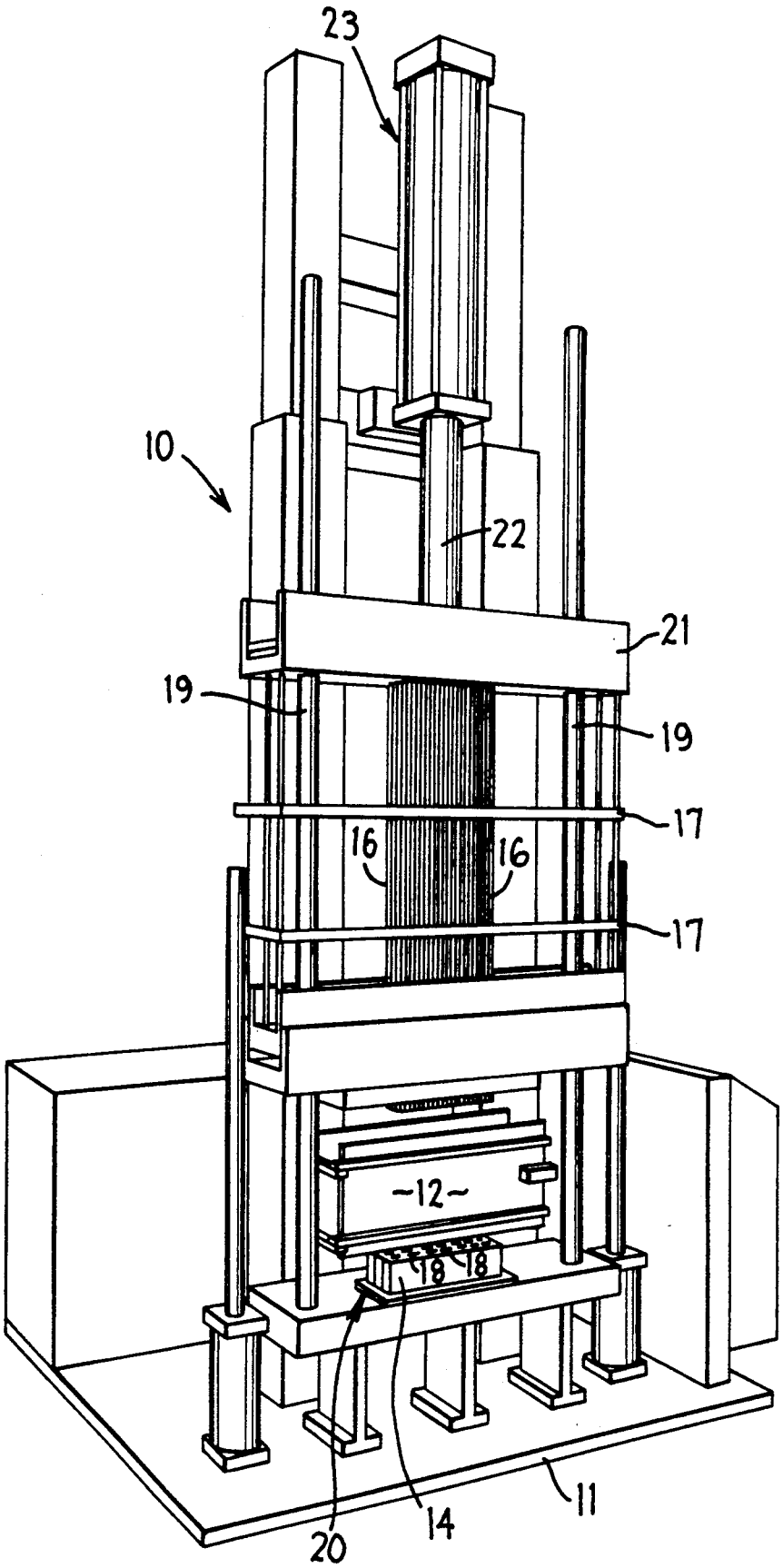
FIG. 1 is a schematic, perspective view of a vertical tube expander incorporating a hairpin-supporting receiver.
Figure 7:
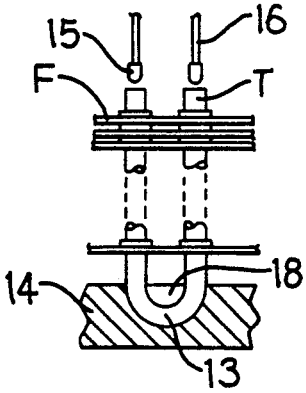
FIG. 7 is a fragmentary, schematic illustration of the tube and fin assembly and expander rods, prior to expanding the tube T.

Referring to FIG. 1, there is illustrated, for background purposes, a representative, vertical, tube expander on which the hairpin-supporting receiver of the present invention can be employed. The expander comprises a frame 10 mounted on a base 11. The tubes T and the fins F to be interlocked with the tubes (not shown in FIG. 1, but illustrated in FIG. 7) are disposed in a container or fixture 12. The tubes T are oriented vertically and the fins are loosely stacked thereon. The hairpin supporting receiver 14, to which this invention relates, supports the reversely curved (hairpin bent) lower ends of the tubes. The receiver 14 is supported on the receiver support plate 20.

A plurality of expander rods 16 corresponding in number and arrangement to the number and arrangement of tubes T, is provided for expanding the tubes. At their lower ends, the expander rods carry expander bullets 15 (FIG. 7) which are effective to expand the tubes into interlocked engagement with the fins when the expander rods are moved vertically downwardly through the tubes. The expander rods 16 extend through guide plates 17 so that the lower ends of the expander rods are vertically aligned with the tubes T. Vertical guide rods 19 are provided for guiding the reciprocating movement of the reciprocal parts of the mechanical tube expander.

A pressure plate 21 is provided for supporting the expander rods 16 for vertical reciprocating movement. The pressure plate 21 is vertically slidably guided by the rods 19. The pressure plate 21 is connected to the piston rod 22 of the piston and cylinder assembly 23 so that the pressure plate can be moved upwardly and downwardly.

As thus far described, the mechanical tube expander 10 (FIG. 1) is of conventional structure. The details of its structure and operation are well known and, accordingly, it is believed unnecessary to describe the mechanical tube expander in greater detail. It will be understood that the invention can be employed in combination with a wide variety of different mechanical tube expanders, including ones for expanding hairpin bent tubes, and that the invention is not limited to the specific mechanical tube expander illustrated in FIG. 1.

Figure 2:
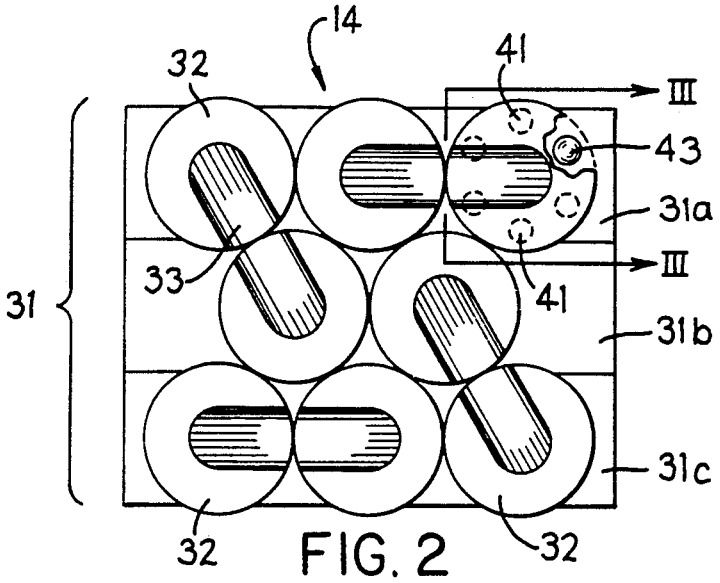
FIG. 2 is a top plan view of a first embodiment of the hairpin-supporting receiver, according to the invention.
Figure 3:
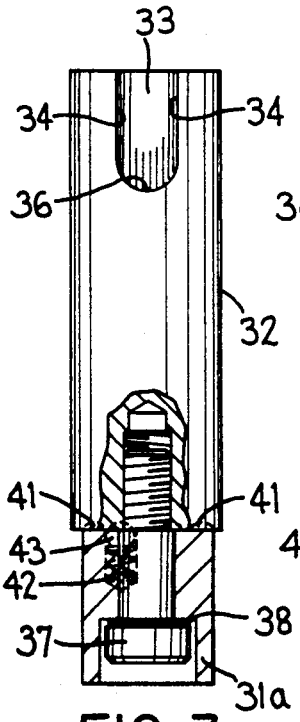
FIG. 3 is a partially broken away view of a receiver post taken along the line III—III of FIG. 2.
Figure 4:
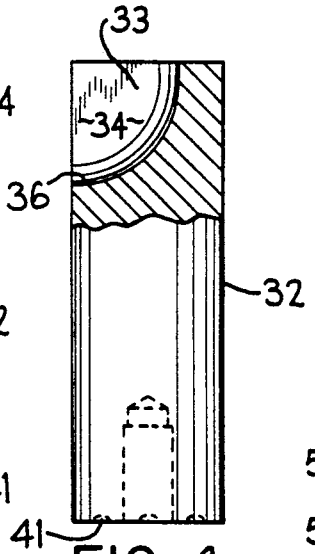
FIG. 4 is a partially broken away side view of the receiver post taken from the right side of FIG. 3.

Referring to FIGS. 2, 3 and 4, in the first embodiment of the invention, the hairpin-supporting receiver 14 is comprised of base means 31 which is affixed, for example, by bolts (not shown), to the receiver support plate 20 (FIG. 1). In the illustrated embodiment, the base means 31 is shown as being made of three separate plates 31*a*, 31*b* and 31*c*, which are arranged in parallel, side-by-side relation to define a substantially rectangular base means 31. It will be understood, however, that the base means 31 can be made of various constructions, such as a one-piece, solid block.

A plurality of upright, elongated, parallel receiver posts 32 extend upwardly from the base means 31 in parallel with and in side-by-side relationship to each other. In the illustrated embodiment, each of the plates 31*a*, 31*b* and 31*c* has a row of receiver posts 32 extending upwardly therefrom. Each post 32 has a cavity 33 in its upper end. In the side view (FIG. 4), the cavity 33 has the shape of substantially one-quarter of a circle, the radius of which is the same as the radius of the 180° bend of the tube T. In the front view, the cavity 33 (FIG. 3) has parallel sidewalls 34 and a substantially semicircular bottom wall 36, the diameter of which is substantially the same as the diameter of the tube T. The cavity 33 is of a size capable of snugly and slidably receiving one-half of the circumference of the 180° bend of the tube T. The cavity 33 opens through the upper wall and through the sidewall of the receiver post 32.

In the arrangement shown in FIG. 2, the receiver posts 32 are shown as being of circular cross-section and of the same diameter. The longitudinal axes of the receiver posts 32 are equally spaced from each other a distance substantially equal to the diameter of the receiver posts so that the peripheries of the receiver posts are substantially tangent to each other. When the cavities 33 of two receiver posts 32 are radially aligned with each other, as shown in plan view in FIG. 2, the two aligned cavities define a semicircular recess for receiving the entirety of the 180° bend of the tube T. The tube arrangement illustrated in FIG. 2 is an equilateral pattern in which, for example, imaginary lines connecting the centers of any two adjacent receiver posts in one row with the receiver post therebetween in the adjacent row define an equilateral triangle. As will be described below, the invention is not limited to an equilateral pattern of the receiver posts 32.

Referring to FIG. 3, each receiver post 32 is mounted on its associated base plate, here plate 31*a*, by a stripper bolt 37 so as to be capable of independent, individual, stepwise, indexing movement about the longitudinal axis of the post. A spring washer 38 acts on the head of the stripper bolt 37 to resiliently urge the bottom wall of the receiver post 32 against the top wall of its associated base plate 31*a*. A series of substantially semicircular recesses 41 is provided in the bottom wall of the receiver post 32 and the recesses are arranged in a circle thereon as shown in broken lines in the upper righthand receiver post 32 in FIG. 2. In the illustrated embodiment, there is a series of six semicircular recesses 41 in the bottom wall of the receiver post 32 so that the receiver post can be selectably and releasably retained in any one of six positions relative to its base plate 31*a*. A blind-ended hole 42 is formed in the base plate 31*a*. The hole 42 is closed at its lower end and its upper end opens through the upper wall of the base plate 31*a* and is adapted to register with one of said recesses 41 at a time when the receiver post 32 is indexed relative to its base plate 31*a*. A spring-urged ball 43 is received in the hole 42 and is urged upwardly therein so that it can project into a recess 41 in the bottom wall of the receiver post 32 when that recess 41 is vertically aligned with the hole 42. The ball 43 thus functions as a ball detent to releasably retain the receiver post 32 in a selected adjustable position relative to its base plate 31*a*.

In use, in order to adjust the position of a receiver post 32, a suitably shaped tool is inserted into the upper end of the cavity 33 and then is twisted in order to rotate the receiver post 32 to the desired position. The receiver post 32 is then releasably locked in that position by the ball detent 43. Adjustment of the positions of each of the receiver posts 32 can be effected without removing the receiver 14 from the base plate 20. The receiver posts 32 can be adjusted so as to dispose pairs of receiver posts in mutually cooperating positions in which their cavities 33 mate to define a groove for receiving the bend of a tube T. Different pairs of receiving posts 32 can be disposed in different mutually cooperating positions, as needed, to accommodate different patterns of the bends of the hairpin tubes T.

By making the base means 31 of a plurality of plates 31*a*, 31*b* and 31*c*, an entire row of receiver posts 32 can be removed as a unit if that row of receiver posts is not to be used and it would interfere with the end sheet of a heat exchanger. When the end sheet is flat, it is not necessary to remove unused receiver posts 32. Receiver posts 32 made for use with one size of tubing, such as ⅜ inch OD tubing, can be interchanged with receiver posts that accommodate a different size of tubing, such as 5/16 inch 0D tubing if the pattern for center distance and row-to-row dimension remain the same.

MODIFICATIONS

Figure 5:
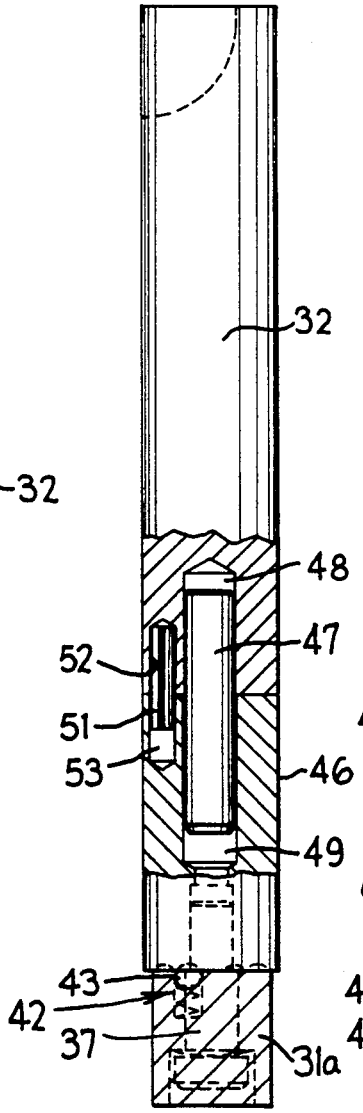
FIG. 5 is a partially broken away view, like FIG. 3, and illustrating a second embodiment of the invention.
Figure 6:
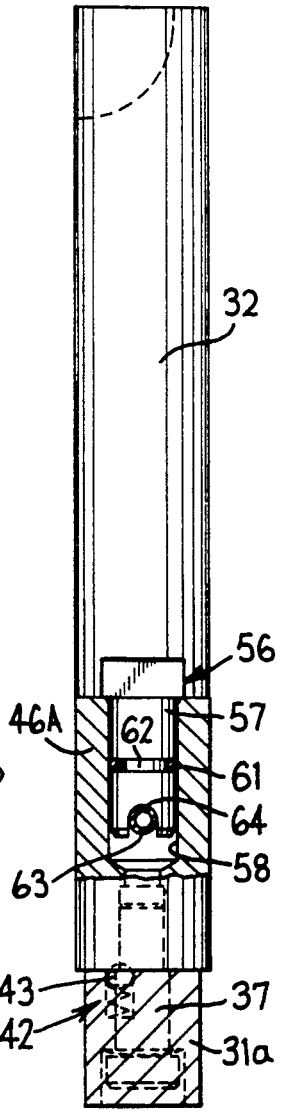
FIG. 6 is a partially broken away view, like FIG. 3, and illustrating a third embodiment of the invention.

FIGS. 5 and 6 illustrate modifications in which the receiver post 32 is removably mounted on an intermediate support 46 or 46A which in turn is attached to the base plate, here the base plate 31*a*.

In the embodiment of FIG. 5, a pull dowel 47 is press fit into a blind-ended vertical hole 48 in the lower end of the receiver post 32. The dowel 47 slidably extends into a vertical, central opening 49 in the upper end of the intermediate support 46. A roll pin 51 is press fit into a laterally offset opening 52 in the receiver post 32 and said roll pin is slidably received in an opening 53 in the intermediate member 46 so as to prevent rotation of the receiver post 32 relative to the intermediate support 46.

In the embodiment of FIG. 6, receiver post 32 has a shank 57 extending into a central opening 58 in the intermediate support 46A. An expandable lock ring 61 is received in a peripheral groove 62 in the shank 57. The lock ring 61 is expandable into a partial groove in the sidewall of the opening 58 whereby to releasably lock the shank to the intermediate member 46A. A roll pin 63 extends transversely through the intermediate support 46A and through a transverse groove 64 in the lower end of the shank 57 to prevent rotation of the receiver post 32 relative to the intermediate support 46A.

Referring to FIG. 6, a pair of flat surfaces 56 is provided and these flat surfaces are located on diametrically opposite sides of the receiver post 32. A tool (not shown) can be placed in contact with the flat surfaces 56 so that the receiver post 32 can be pried loose from intermediate support 46A.

The receiver assemblies of FIGS. 5 and 6 are constructed so that each of the receiver posts 32 can be removed from the intermediate support 46 or 46A. Thus, a receiver post 32 can be removed if it is in a non-used row and interferes with the end sheet of the heat exchanger. Also, an entire row of receiver posts can be removed as a unit by removing the plate, such as plate 31*a*, on which the row is mounted.

Figure 8:
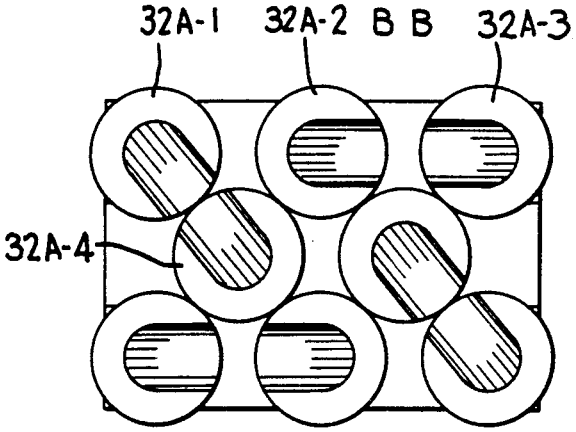
FIG. 8 is a view like FIG. 2, but illustrating a different arrangement of the receiver posts.
Figures 9, 10:
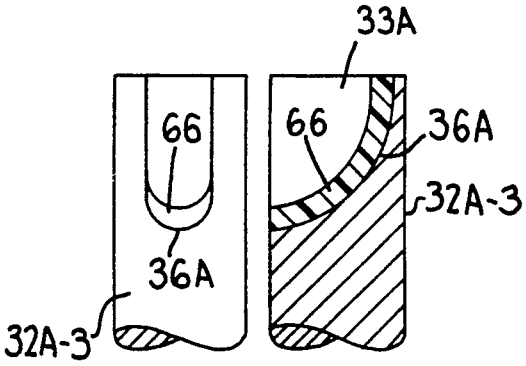
FIG. 9 is a view like a fragment of FIG. 3 and showing the use of an elastomeric cushion in the cavity.
FIG. 10 is a view like a fragment of FIG. 4 and showing the elastomeric cushion in cross-section.

FIGS. 8, 9 and 10 illustrate a further modification in which the receiver posts 32A are arranged in a non-equilateral pattern. Referring to FIG. 8, the receiver posts 32A in each of the rows, such as receiver posts 32A-1, 32A-2 and 32A-3, are positioned so that there is a space B-B between the opposing peripheral surfaces of each pair of adjacent receiver posts in that row. On the other hand, the peripheries of the receiver posts 32A in one row are substantially tangent to the peripheries of the adjacent receiver posts 32A in the adjacent row. For example, there is no substantial space between the peripheries of receiver posts 32A-1 and 32A-2, on the one hand, and the receiver post 32A-4 in the adjacent row.

When it is desired to position two adjacent receiver posts in the same row in mating relationship to form a recess for receiving a bend of a hairpin tube, as shown by receiver posts 32A-2 and 32A-3 in FIG. 8, the bottom wall 36A of each of the cavities 33A is lined with a layer 66 of a suitable elastomeric material, such as molded polyurethane rubber. The elastomeric layer 66 cushions the bend of the hairpin tube T when the tube is being expanded so that the wall of the bend is cushioned from forcible contact with the metal edge of the bottom wall 36A of the cavity 33A whereby to avoid transition marks or distortions in the bend in the open space B-B between the receiver posts 32A.

Figure 12:
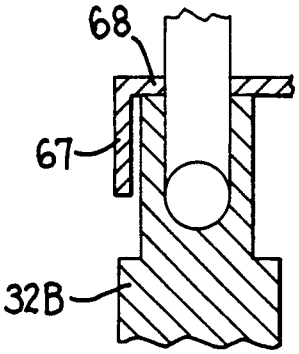
FIG. 12 is a sectional view taken along the line XII—XII of FIG. 11.
Figure 11:
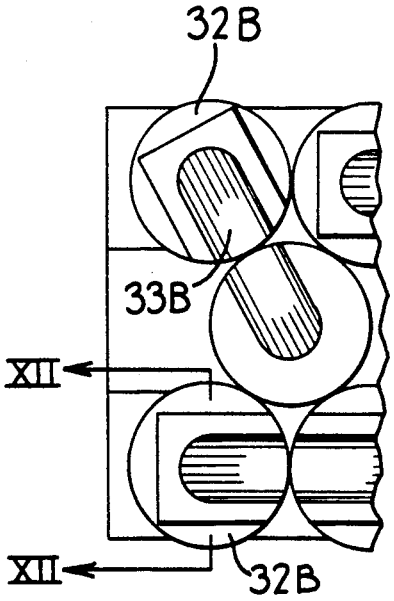
FIG. 11 is a view corresponding to a portion of FIG. 2 and illustrating a further modification of the invention wherein one or more of the receiver posts is shaped for receiving a tube sheet which has a downwardly bent flange.

Referring to FIGS. 11 and 12, in this embodiment the upper ends of one or more of the receiver posts 32B are cut away along one or more sides to form one or more flat walls so that the downwardly extending flange portion 67 of the end sheet 68 of a tube- and fin-type heat exchanger can be received. In this embodiment, the sidewalls at the upper ends of the receiver posts 32B can be shaped to receive nonflat portions of the end sheet in order properly to position the end sheet relative to the tubes. The lower portions of the receiver posts 32B are circular or at least lie within a circular surface of a revolution so that the receiver posts can be indexed with respect to the base means, as described above.

Although particular preferred embodiments of the invention have been disclosed, the invention contemplates such changes or modifications therein as lie within the scope of the appended claims.

We claim:

1. In a mechanical tube expander for expanding hairpin tubes into interlocked relationship with fins, comprising a frame, means for holding on said frame an assembly of fins loosely stacked on hairpin tubes, a receiver mounted on said frame and adapted for supporting the bent portions of said hairpin tubes, a pressure plate carrying a plurality of expander rods which are aligned with the tubes, said expander rods having tube-expanding means at one end thereof and means for reciprocating said expander rods with respect to said assembly in order to expand the tubes into interlocked relationship with the fins that are stacked thereon, the improvement which comprises: said receiver comprises base means; a plurality of upright, elongated, parallel, adjacent receiver posts extending upwardly from said base means, each of said receiver posts having a cavity in its upper end for receiving a portion of the hairpin bend of a hairpin tube; means supporting each of said receiver posts for individual rotation with respect to said base means about the longitudinal axis thereof; detent means acting between said base means and said receiver posts for releasably locking each of said receiver posts in one of a plurality of circumferentially spaced-apart positions whereby the pattern of the cavities in the upper ends of said receiver posts can be changed by individually rotating said receiver posts.

2. A mechanical tube expander as claimed in claim 1 wherein said detent means comprises a series of circumferentially spaced-apart recesses arranged in a circle and a spring-urged ball receivable in one of said recesses at a time, one of said ball and said series of recesses being provided in fixed position relative to the receiver posts and the other being provided in said base means.

3. A mechanical tube expander as claimed in claim 1 wherein said cavity has parallel, opposed sidewalls each in the shape of a quarter of a circle and has a bottom wall which is semicircular in cross-section.

4. A mechanical tube expander as claimed in claim 1 wherein said detent means for each receiver post comprises a series of circumferentially spaced-apart recesses arranged in a circle in the bottom wall of said receiver post and opening downwardly, said base means having a blind-ended hole which opens upwardly through the upper wall of said base means and is vertically aligned with said circle, a spring-urged ball disposed in said hole and urged upwardly therein so that it is receivable in one of said recesses at a time, fastening means securing said receiver posts to said base means so that said receiver post can move upwardly away from said base means to a small extent and flexible washer means for resiliently urging said fastener and said receiver post downwardly so that the bottom wall of the receiver post normally bears against the upper wall of said base means.

5. A mechanical tube expander as claimed in claim 1 wherein each said receiver post comprises an upper part and a lower part and means releasably fixedly securing together said upper and lower parts.

6. A mechanical tube expander as claimed in claim 1 wherein said receiver posts are of circular cross-section.

7. A mechanical tube expander as claimed in claim 1 wherein the upper end of at least one of said receiver posts is cut away to provide a flat portion for receiving a flange on a tube sheet.

8. A mechanical tube expander as claimed in claim 1 wherein said receiver posts are arranged in a plurality of parallel rows, each row being comprised of a plurality of receiver posts which are positioned in parallel side-by-side relation with their peripheral surfaces being tangent to and substantially in contact with each other, the receiver posts in adjacent rows being laterally offset from each other and with the peripheral surface of a receiver post in one row being tangent to and in contact with the peripheral surfaces of two receiver posts in the adjacent row.

9. A mechanical tube expander as claimed in claim 1 in which said receiver posts are arranged in a plurality of parallel rows, each row being comprised of a plurality of receiver posts which are positioned in parallel, spaced-apart relationship, the receiver posts in adjacent rows being laterally offset from each other and with the peripheral surface of a receiver post in one row being tangent to and in contact with the peripheral surfaces of two receiver posts in the adjacent row.

10. A hairpin tube receiver, comprising: base means; a plurality of upright, elongated, parallel, adjacent receiver posts extending upwardly from said base means, each of said receiver posts having a cavity in its upper end for receiving a portion of the hairpin bend of a hairpin tube; means supporting each of said receiver posts for individual rotation with respect to said base means about the longitudinal axis thereof; detent means acting between said base means and said receiver posts for releasably locking each of said receiver posts in one of a plurality of circumferentially spaced-apart positions whereby the pattern of the cavities in the upper ends of said receiver posts can be changed by individually rotating said receiver posts.

11. A hairpin tube receiver as claimed in claim 10 wherein said detent means comprises a series of circumferentially spaced-apart recesses arranged in a circle and a spring-urged ball receivable in one of said recesses at a time, one of said ball and said series of recesses being provided in fixed position relative to the receiver post and the other being provided in said base means.

12. A hairpin tube receiver as claimed in claim 10 wherein said cavity has parallel, opposed sidewalls each in the shape of a quarter of a circle and has a bottom wall which is semicircular in cross-section.

13. A hairpin tube receiver as claimed in claim 10 wherein said detent means for each receiver post comprises a series of circumferentially spaced-apart recesses arranged in a circle in the bottom wall of said receiver post and opening downwardly, said base means having a blind-ended hole which opens upwardly through the upper wall of said base means and is vertically aligned with said circle, a spring-urged ball disposed in said hole and urged upwardly therein so that it is receivable in one of said recesses at a time, fastening means securing said receiver post to said base means so that said receiver post can move upwardly away from said base means to a small extent and flexible washer means for resiliently urging said fastener and said receiver post downwardly so that the bottom wall of the receiver post normally bears against the upper wall of said base means.

14. A hairpin tube receiver as claimed in claim 10 wherein each said receiver post comprises an upper part and a lower part and means releasably fixedly securing together said upper and lower parts.

15. A hairpin tube receiver as claimed in claim 10 wherein said receiver posts are of circular cross-section.

16. A hairpin tube receiver as claimed in claim 10 wherein the upper end of at least one of said receiver posts is cut away to provide a flat portion for receiving a flange on a tube sheet.

17. A hairpin tube receiver as claimed in claim 10 wherein said receiver posts are arranged in a plurality of parallel rows, each row being comprised of a plurality of receiver posts which are positioned in parallel, side-by-side relation with their peripheral surfaces being tangent to and substantially in contact with each other, the receiver posts in adjacent rows being laterally offset from each other and with the peripheral surface of a receiver post in one row being tangent to and in contact with the peripheral surfaces of two receiver posts in the adjacent row.

18. A hairpin tube receiver as claimed in claim 10 in which said receiver posts are arranged in a plurality of parallel rows, each row being comprised of a plurality of receiver posts which are positioned in parallel, spaced-apart relationship, the receiver posts in adjacent rows being laterally offset from each other and with the peripheral surface of a receiver post in one row being tangent to and in contact with the peripheral surfaces of two receiver posts in the adjacent row.

* * * * *